US011821145B2

(12) United States Patent
Chen et al.

(10) Patent No.: US 11,821,145 B2
(45) Date of Patent: Nov. 21, 2023

(54) PULP MOLD

(71) Applicant: Yulan Green Technology Co., Ltd., Yilan County (TW)

(72) Inventors: Chun-Hsiung Chen, Yilan County (TW); Kao-Yi Chang, Yilan County (TW)

(73) Assignee: Yulan Green Technology Co., Ltd., Yilan County (TW)

( * ) Notice: Subject to any disclaimer, the term of this patent is extended or adjusted under 35 U.S.C. 154(b) by 0 days.

(21) Appl. No.: 17/953,678

(22) Filed: Sep. 27, 2022

(65) Prior Publication Data

US 2023/0235515 A1 Jul. 27, 2023

(30) Foreign Application Priority Data

Jan. 27, 2022 (TW) ..... 111103727

(51) Int. Cl.
*D21J 7/00* (2006.01)
*D21J 3/10* (2006.01)

(52) U.S. Cl.
CPC .. *D21J 7/00* (2013.01); *D21J 3/10* (2013.01)

(58) Field of Classification Search
CPC ..... D21J 7/00; D21J 3/10
USPC ..... 162/382
See application file for complete search history.

(56) References Cited

FOREIGN PATENT DOCUMENTS

| | | |
|---|---|---|
| CN | 107386014 A | 11/2017 |
| CN | 211897610 U | 11/2020 |
| CN | 215289499 U | 12/2021 |

OTHER PUBLICATIONS

Search Report appended to an Office Action, which was issued to Taiwanese counterpart application No. 111103727 by the TIPO on Sep. 23, 2022, with an English translation thereof.

*Primary Examiner* — Mark Halpern

(57) ABSTRACT

A pulp mold includes a mold main body extending along a longitudinal axis and having an inner surface that defines a chamber, an outer surface opposite to the inner surface, and a plurality of channel grooves extending inwardly from the outer surface toward the inner surface and extending along a length of the outer surface. The chamber is divided into a plurality of chamber sections decreasing in diameters gradually and upwardly from the opening along the longitudinal axis. Each channel groove does not communicate with the chamber. A plurality of air holes extend from the outer surface to the inner surface, pass through the channel grooves, and communicate the chamber with the outside.

11 Claims, 10 Drawing Sheets

PULP MOLD

CROSS-REFERENCE TO RELATED APPLICATION

This application claims priority to Taiwanese Invention Patent Application No. 111103727, filed on Jan. 27, 2022.

FIELD

The disclosure relates to a mold, and more particularly to a pulp mold.

BACKGROUND

Referring to FIG. 1, a pulp mold 1, as disclosed in Chinese Patent No. CN1164832, mainly includes a fluid-permeable material 20 covering an outer surface of a core 10, a hollow chamber 11 formed in the center of an upper part of the core 10 and with a same radial width for air to flow in and out, and a plurality of fluid communication passages 14 radially extending from an inner surface 13 of the hollow chamber 11 to an outer surface 12 of the core 10.

When pulp 2 is accumulated in layers on the outer surface 12 of the core 10, suction air flow generated by the negative pressure can pass through the hollow chamber 11 and the fluid communication passages 14 to remove water in the pulp 2, and then set the shape thereof after hot pressing; while blowing air flow generated by the positive pressure can blow away the shaped finished product through the hollow chamber 11 and the fluid communication passages 14.

Although the aforesaid pulp mold 1 can achieve its intended purpose, it has the following drawbacks:

1. During suctioning of the pulp 2 by the fluid communication passages 14, the pulp 2 is likely to suck into the corresponding fluid communication passage 14 and formed barbs proximate to an end of the inner surface 13, so that it is not easy to demold, which reduces the yield of finished products.

2. Under the same volume, the size of the volume of the hollow chamber 11 will determine the quantity of air flow and the speed of heat dissipation. When the volume of the hollow chamber 11 is large and the wall thickness of the pulp mold 1 is thin, although the quantity of the air flow can be increased to improve the water discharge and demolding effects, because the wall thickness is thin, heat energy is easily dissipated and cannot be collected, thereby affecting the hot pressing and shaping effect. On the contrary, when the volume of the hollow chamber 11 is small and the wall thickness of the pulp mold 1 is thick, although the effects of heat collection and preservation can be improved, there will be a problem of not easy to demold due to small quantity of air flow.

Referring to FIGS. 2 and 3, another kind of pulp mold 3 currently available in the market mainly uses the method of turning, drilling, etc., to process a plurality of channels 31 extending along a longitudinal axis (X), and a plurality of linear grooves 32 communicating the outside and the channels 31 are formed on an outer surface by a linear cutting process. Through this, air can flow through the linear grooves 32, and the problem of formation of the barbs encountered by the aforesaid pulp mold 1 can be resolved.

However, this kind of pulp mold 3 processed by turning, drilling and linear cutting is expensive. That is, the sum of the linear cutting cost of only one pulp mold 3 and the turning and drilling cost of the pulp mold 3 are high. Taking one linear cutting machine as an example, the producing time of each pulp mold 3 takes about two days, not only is the cost high and the processing time long, but also the linear grooves 32 in comparison with the fluid communication passages 14 of FIG. 1 have the disadvantage of releasing the pressure too quickly.

SUMMARY

Therefore, an object of the present disclosure is to provide a pulp mold that can alleviate at least one of the drawbacks of the prior art.

According to this disclosure, a pulp mold is configured to produce a container formed from pulp. The container includes a container main body, and an annular flange formed on one end of the container main body. The pulp mold includes a mold main body extending along a longitudinal axis and having an inner surface, an outer surface, a plurality of channel grooves, and a plurality of air holes.

The inner surface defines a chamber that is suitable for air to flow in and out. The chamber has an opening, and is divided into a plurality of chamber sections decreasing in diameters gradually and upwardly from the opening along the longitudinal axis. The outer surface is opposite to the inner surface. The channel grooves extend inwardly from the outer surface toward the inner surface, and extend along a length of the outer surface. Each channel groove does not communicate with the chamber. The air holes extend from the outer surface to the inner surface, and pass through the channel grooves. The air holes communicate the chamber with the outside.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
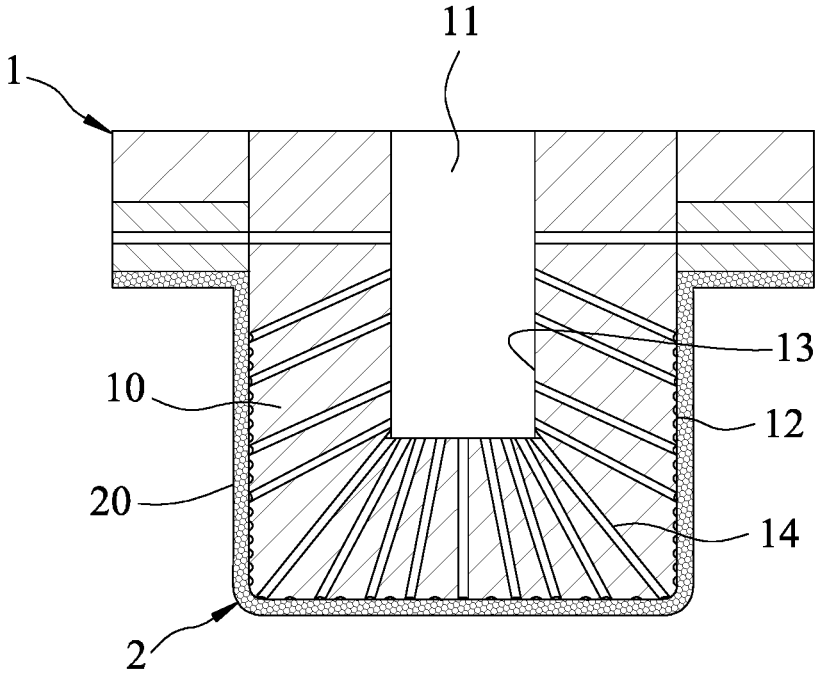
FIG.1 PRIOR ART
FIG. 1 is a sectional view of a pulp mold disclosed in Chinese Patent No. CN1164832.
Figure 2:
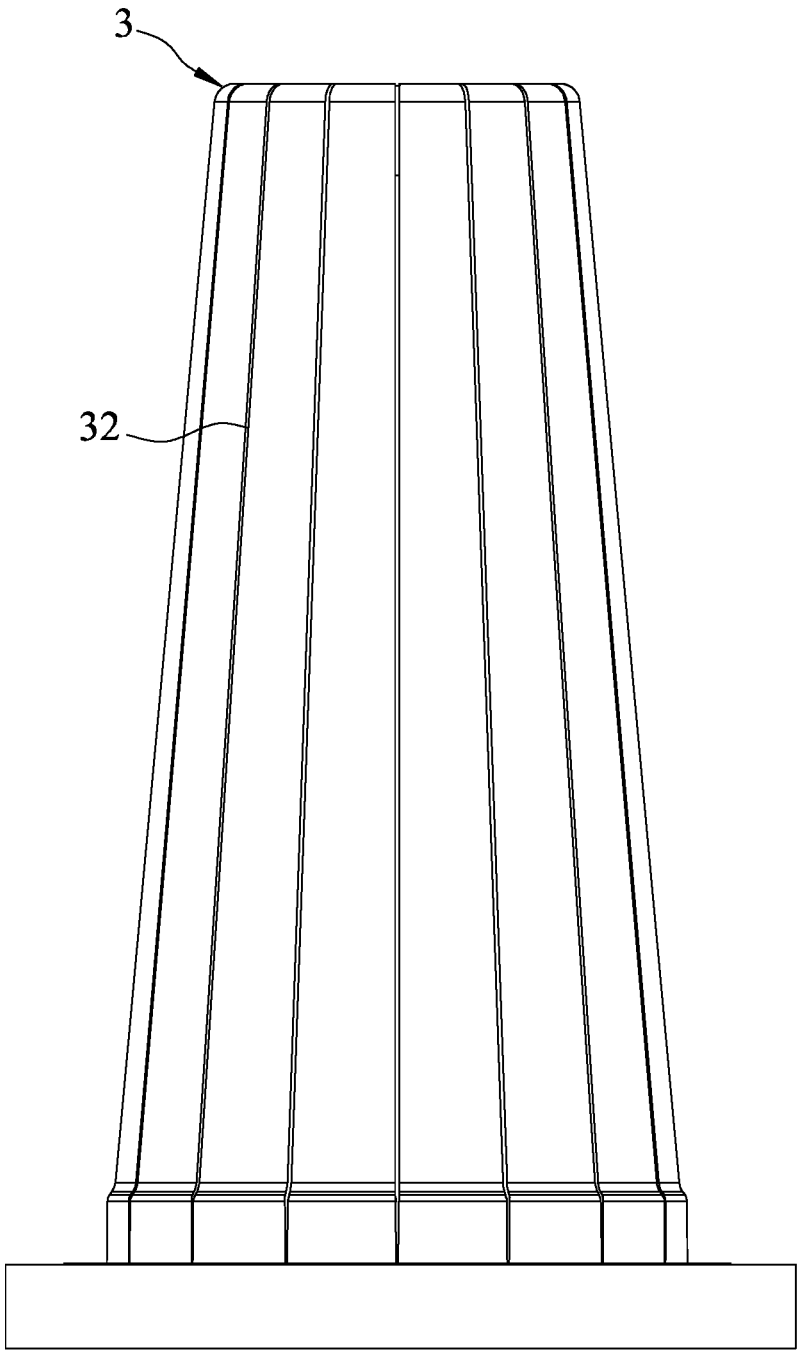
FIG.2 PRIOR ART
FIG. 2 is a front view of another kind of pulp mold currently available in the market.
Figure 3:
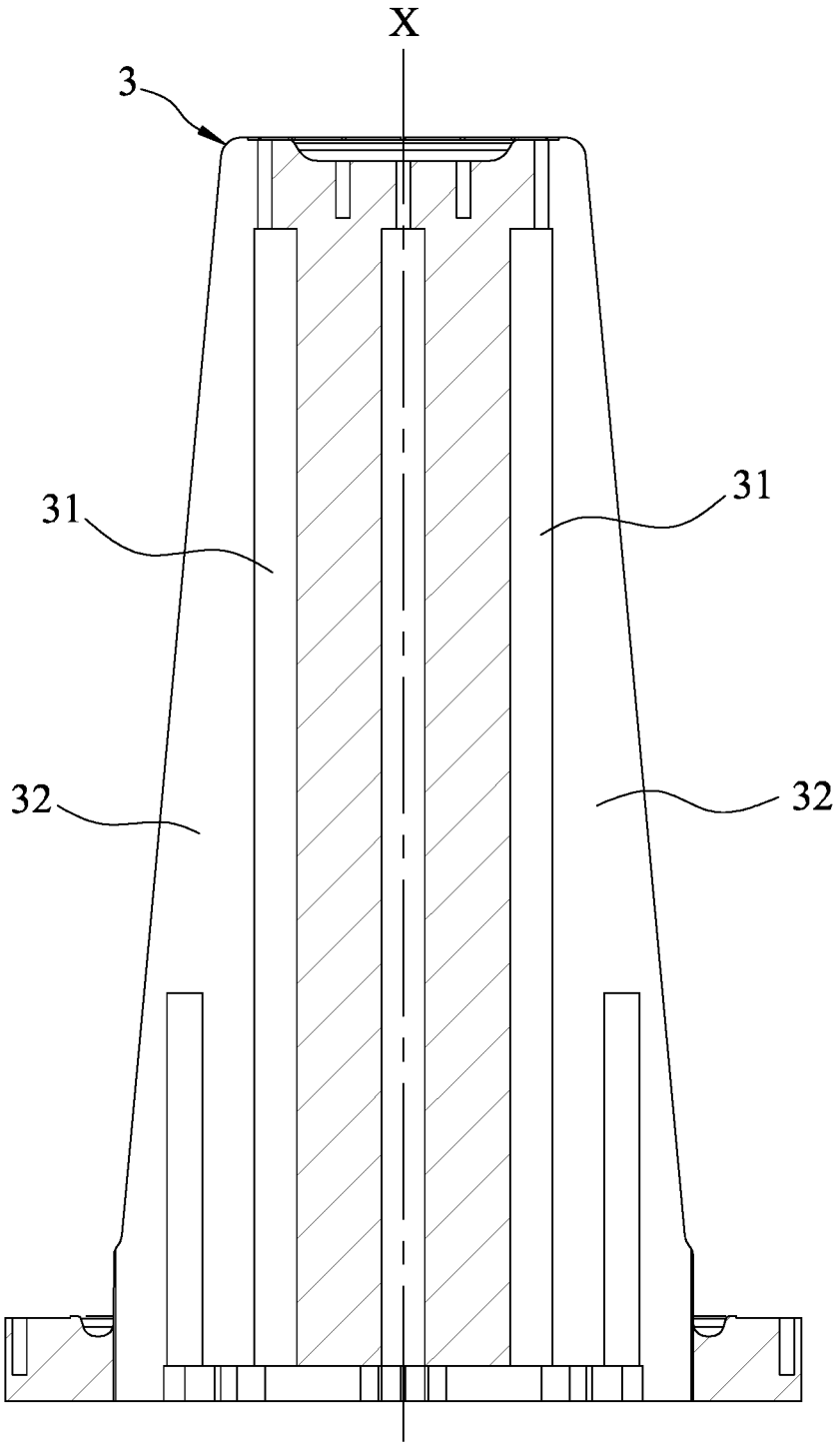
FIG.3 PRIOR ART
FIG. 3 is a sectional view of FIG. 2.

Referring to FIGS. 4 to 7, a pulp mold 5 is configured to produce a container 4 (see FIG. 8) formed from pulp, and includes a frustoconical mold main body 50 extending along a longitudinal axis (X), and an annular flange 58 extending outwardly and radially from the bottom of the mold main body 50. The mold main body 50 has an inner surface 52, an outer surface 53, a plurality of channel grooves 54, a plurality of air holes 55, and an annular protrusion 57.

The inner surface 52 defines a chamber 51 extending along the longitudinal axis (X) and suitable for air to flow in and out. The chamber 51 has an opening 511, and is divided into four chamber sections 512 decreasing in diameters gradually and upwardly from the opening 511 along the longitudinal axis (X). In this embodiment, the inner surface 52 includes three step portions 521 spaced apart from each other along the longitudinal axis (X). Each step portion 521 cooperates with the inner surface 52 to define a corresponding one of the chamber sections 512.

The outer surface 53 is opposite to the inner surface 52, and includes a conical surface portion 531 surrounding the longitudinal axis (X), and an end surface portion 532 connected to a narrow end of the conical surface portion 531 that is opposite to the opening 511. The conical surface portion 531 forms a first angle (θ1) with the longitudinal axis (X). The first angle (θ1) ranges from 3 to 15 degrees, and preferably, 5 degrees.

The channel grooves 54 are formed on the conical surface portion 531 of the outer surface 53, and extend along a length thereof. Specifically, the channel grooves 54 extend inwardly from the conical surface portion 531 toward the inner surface 52, and are distributed equidistantly around the conical surface portion 531. The number of the channel grooves 54 ranges from 3 to 24. Preferably, the number of the channel grooves 54 is 16. Each channel groove 54 does not communicate with the chamber 51, and has a depth of 0.1 to 5 mm, and a width of 0.1 to 3 mm. Preferably, the depth is 0.6 mm, and the width is 1.5 mm.

The air holes 55 extend from the conical surface portion 531 to the inner surface 52 to communicate the chamber 51 with the outside. In this embodiment, a portion of the air holes 55 pass through the channel grooves 54, and are arranged at equal intervals along an extending direction of the channel grooves 54, while the other portion of the air holes 55 pass through the end surface portion 532. Each air hole 55 has a diameter of 0.5 to 3 mm, and preferably, 1.5 mm. An extending direction of each air hole 55 passing through a corresponding channel groove 54 forms a second angle (02) with a reference plane (C) perpendicular to the longitudinal axis (X). The second angle (02) ranges from 20 to 60 degrees, and preferably, 45 degrees. Each channel groove 54 communicates with more than five air holes 55.

The annular protrusion 57 extends outwardly and radially from a wide end of the conical surface portion 531.

The annular flange 58 has a top surface 581, and an annular recess 582 extending inwardly from the top surface 581 and immediately adjacent to the annular protrusion 57.

To make the pulp mold 5, the chamber sections 512 with different diameters, the channel grooves 54, the air holes 55, the annular protrusion 57 and the annular recess 582 can be completed by using only the processing methods, such as turning, milling grooves, and drilling, so that not only is the processing easy and the processing speed fast to produce about eight to twelve pulp molds 5 in one day, but also the production cost of each pulp mold 5 can be reduced to a minimum.

The pulp mold 5 is suitable for connecting with a vacuum pump (not shown) to generate negative pressure, and is suitable for connecting with a pressure pump (not shown) to generate positive pressure.

Figure 6:
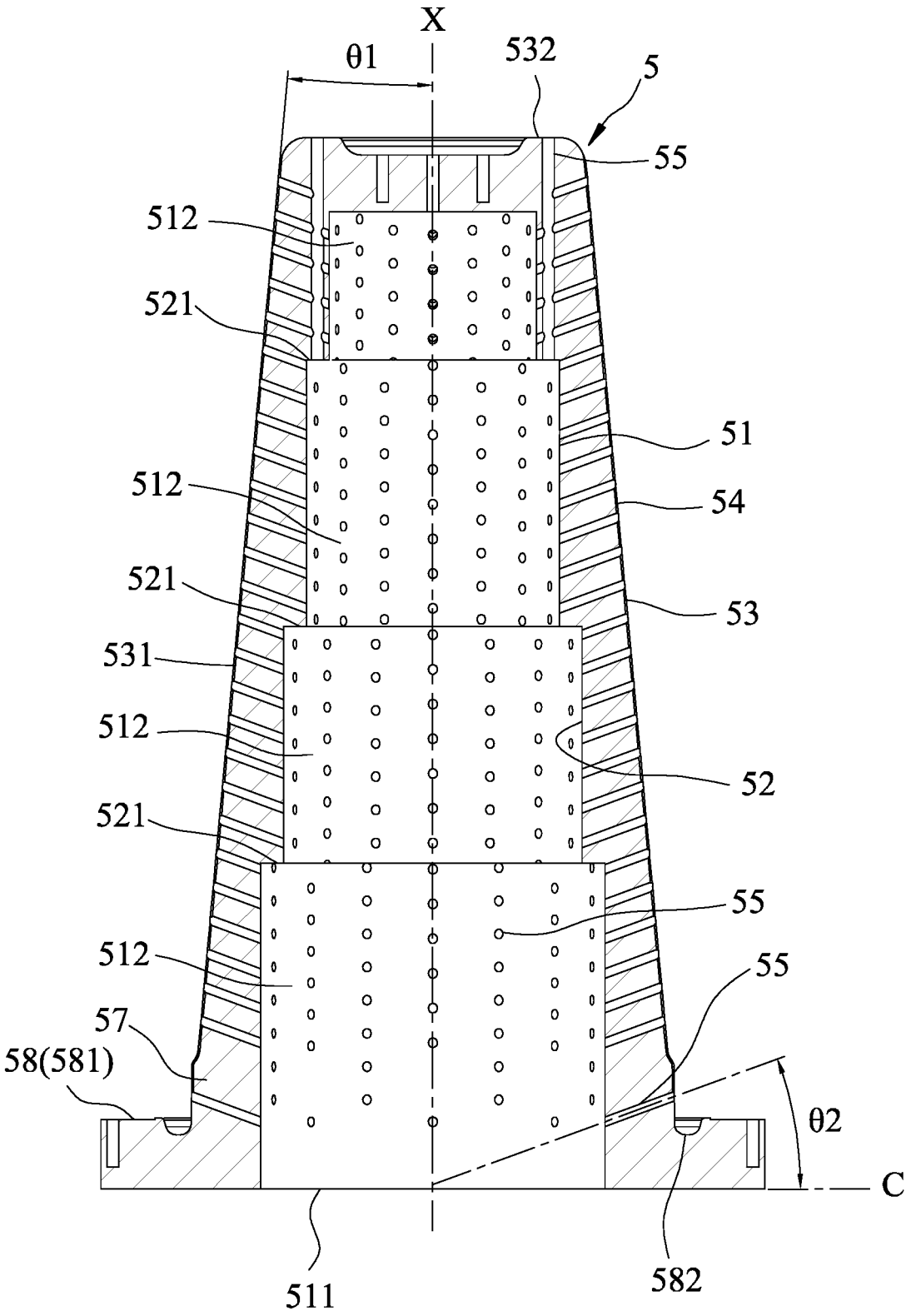
FIG. 6 is a sectional view of the embodiment.
Figure 7:
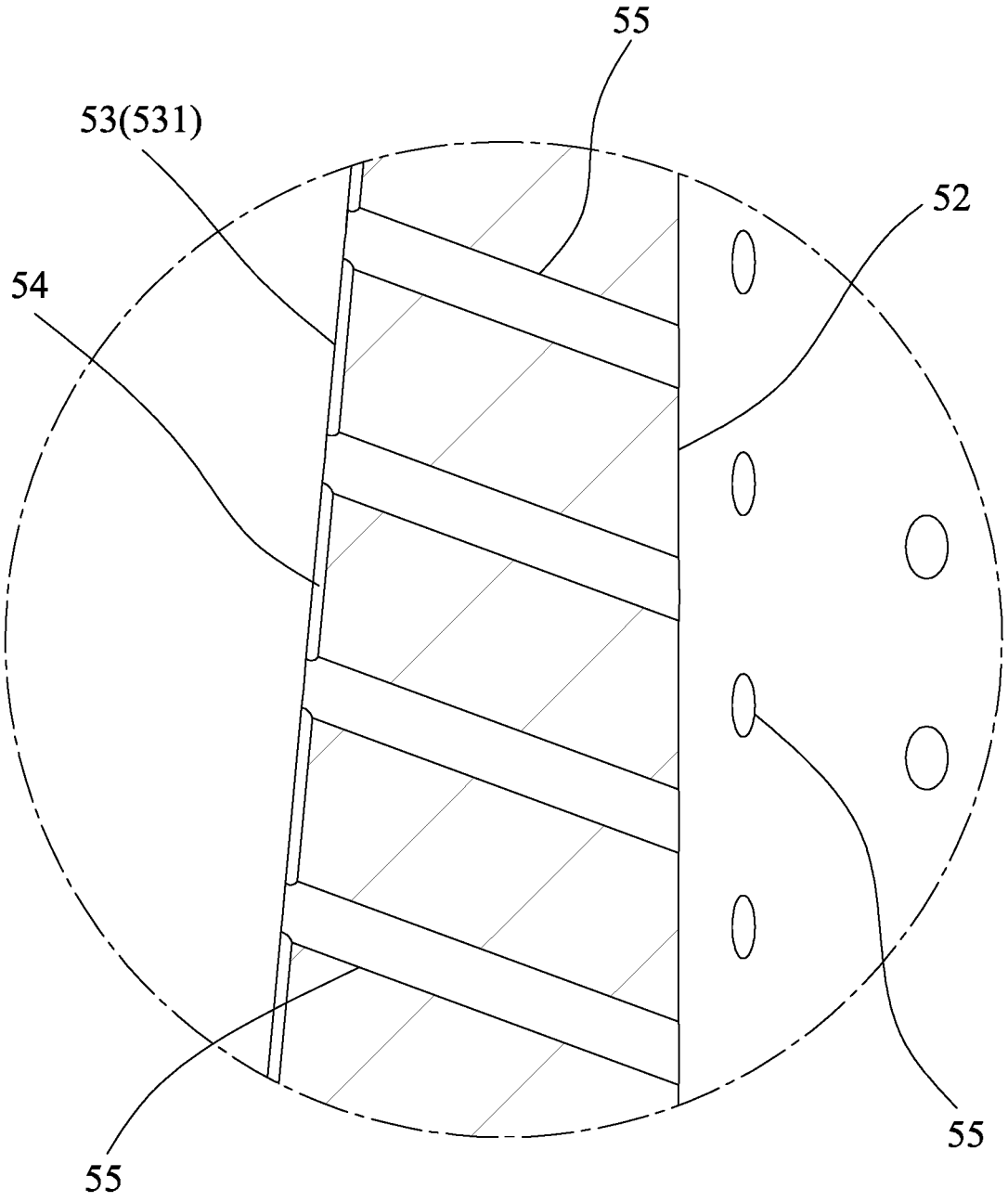
FIG. 7 is another enlarged fragmentary perspective view of the embodiment.
Figure 8:
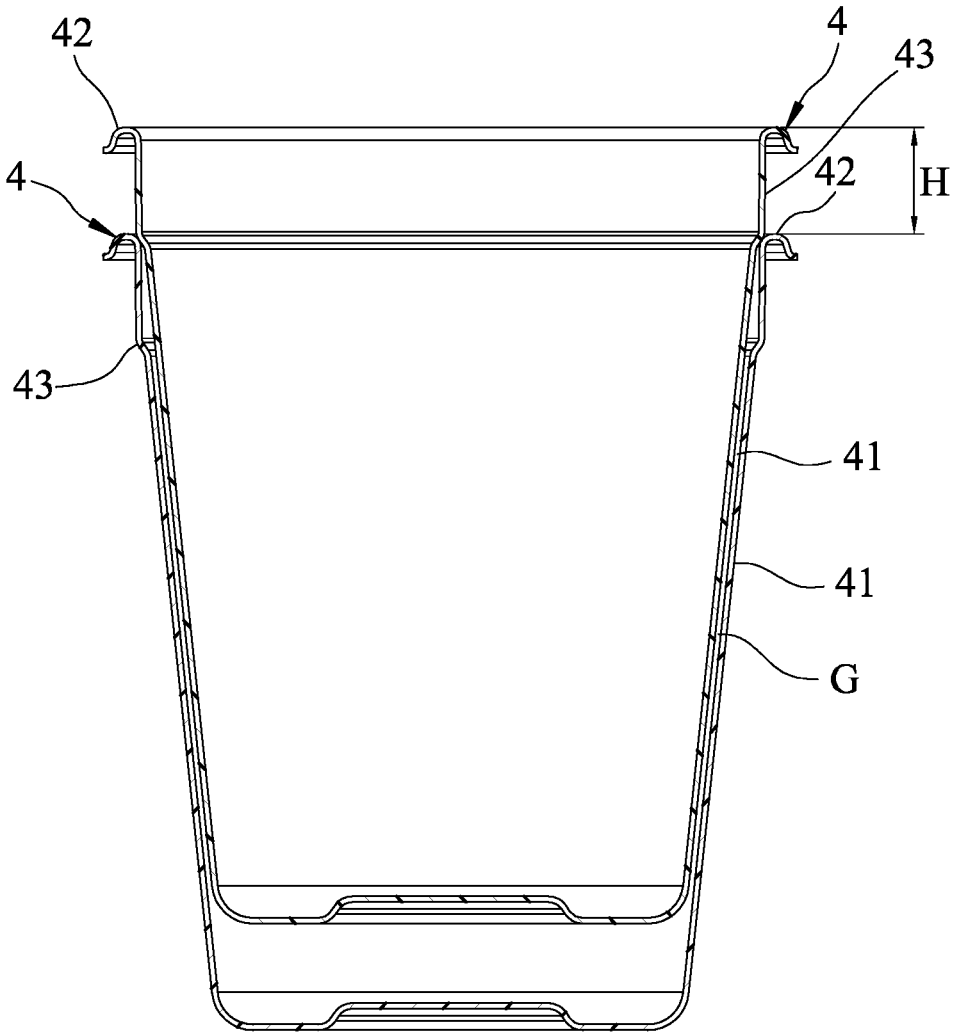
FIG. 8 is a sectional view, illustrating how two containers produced using the embodiment are stacked on each other.

Referring to FIG. 8, in combination with FIG. 6, when pulp is accumulated in layers on the outer surface 53, the suction air flow generated by the negative pressure can remove the water in the pulp through the chamber 51 and the air holes 55, and after dehydration and hot pressing with other molds (not shown), the pulp is shaped into a finished product. Finally, the blowing air flow generated by the positive pressure can blow away the shaped finished product through the chamber 51 and the air holes 55 to obtain the container 4. Since the manufacturing process of pulp product is not a technical feature of the present disclosure, and those with ordinary knowledge in the field of art can infer the extended details according to the above description, no further description will be provided.

What is important is that, when the suction air flow passes through the chamber 51 and the air holes 55 to remove the water in the pulp, the channel grooves 54 of this disclosure which do not communicate with the chamber 51 can be used to temporarily receive the pulp therein and prevent the pulp from passing through the air holes 55 to form barbs, so that the above-mentioned finished product after being hot-pressed and shaped can be easily blown away from the pulp mold 5, thereby achieving the purpose of demolding and improving the yield of the good product.

With reference to FIGS. 6 and 8, it is worth noting that the container 4 produced from the pulp mold 5 includes a container main body 41, an annular flange 42 formed on one end of the container main body 41, and an annular protrusion 43 proximate to the annular flange 42. The annular flange 42 is formed from the pulp corresponding to the annular recess 582, while the annular protrusion 43 is formed from the pulp corresponding to the annular protrusion 57.

When a plurality of containers 4 are stacked (only two are shown in FIG. 8), the annular protrusion 43 of each container 4 will be blocked by the annular flange 42 of an adjacent container 4 and will abut against the same, so that a gap (G) is formed between the main bodies 41 of two adjacent containers 4, and a stack height (H) is defined between the annular flanges 42 of the two adjacent containers 4. Through this, a space for air flow can be formed through the gap (G) to prevent airtight contact between the stacked containers 4, so that taking out of a corresponding container 4 is convenient and smooth.

It is worth to mention herein that, if the first angle (θ1) is smaller than 3 degrees, because the draft angle is too small, the yield of good products is extremely low, and is not easy to produce good products, thereby leading to the stack height (H) of the containers 4 becoming large, the number of packaging bags becoming less, the volume becoming large, and increase in the transportation cost. On the other hand, if the first angle (θ1) is larger than 15 degrees, although the stack height (H) of the containers 4 can be decreased, the height of the finished product is easily limited, making the volume of the container 4 becomes small.

Moreover, although the container 4 produced by the pulp mold 5 has roughly visible stripes corresponding to the channel grooves 54, it will not affect the function of use and the appearance of the product. It is worth noting that, if the depth of each channel groove 54 is less than 0.1 mm and the width thereof is less than 0.1 mm, although the traces of the stripes are not obvious, the problems of barbs and demolding cannot be effectively resolved; and, if the depth of each channel groove 54 is greater than 5 mm and the width thereof is greater than 3 mm, the traces of the stripes are relatively obvious, and although the problems of barbs and demolding can be resolved, when the number of production times is large, it is easy to cause gap to become plugged with pulp, so that demolding cannot be achieved easily and smoothly.

If the second angle (02) is smaller than 20 degrees, the flow direction of air is close to the reference plane (C) (close to a horizontal state), because the thrust along the longitudinal axis (X) is not enough to detach the finished product from the pulp mold 5, demolding of the finished product is not easy; and, if the second angle (02) is greater than 60 degrees, the flow direction of the air is close to the longitudinal axis (X) (close to a vertical state and abut on the conical surface portion 531), because the thrust acting on the container main body 41 is not enough to separate the container main body 41 from the pulp mold 5, demolding of the finished product is also not easy.

Figure 4:
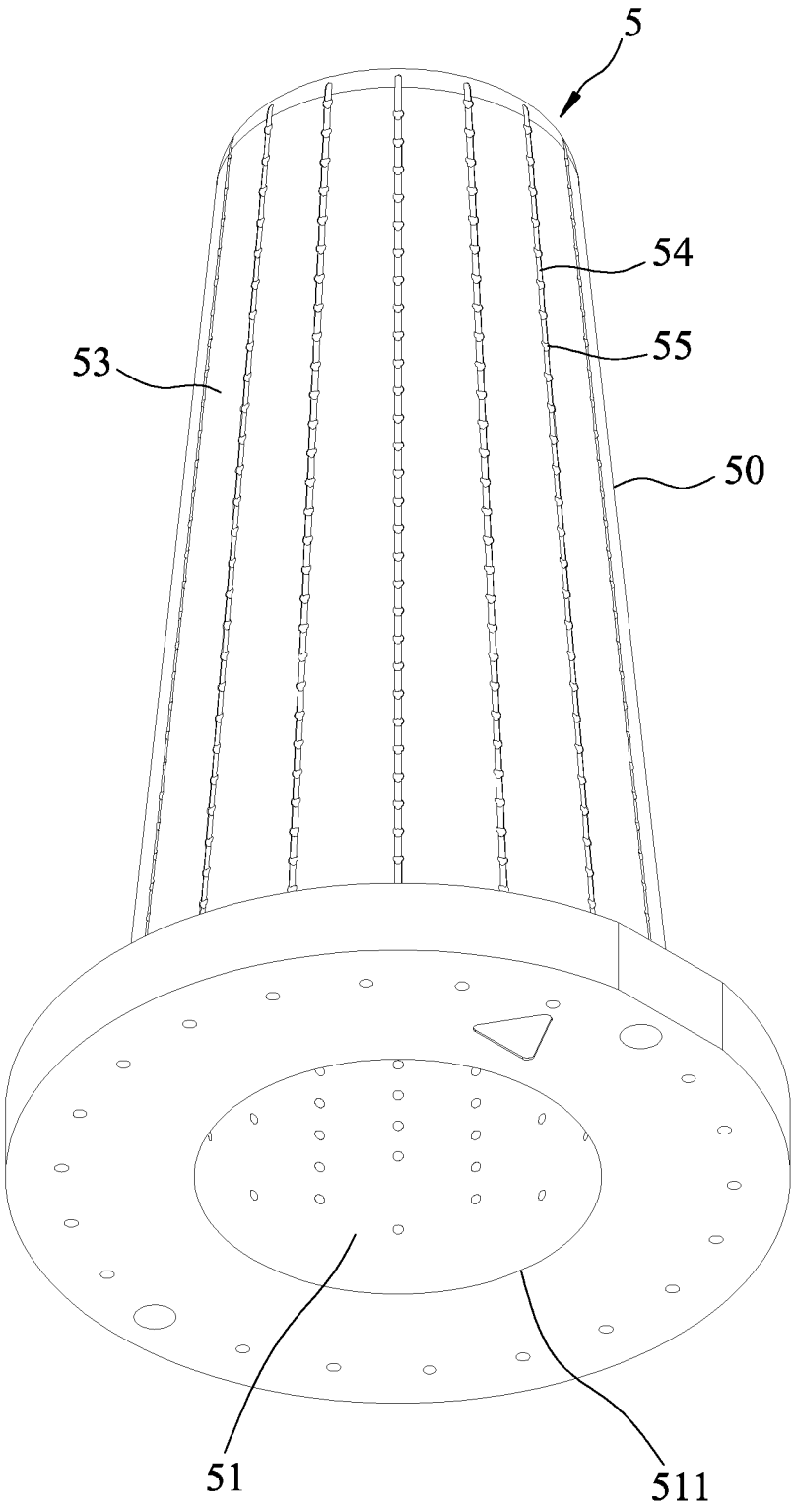
FIG. 4 is a perspective view of a pulp mold according to an embodiment of the present disclosure.
Figure 5:
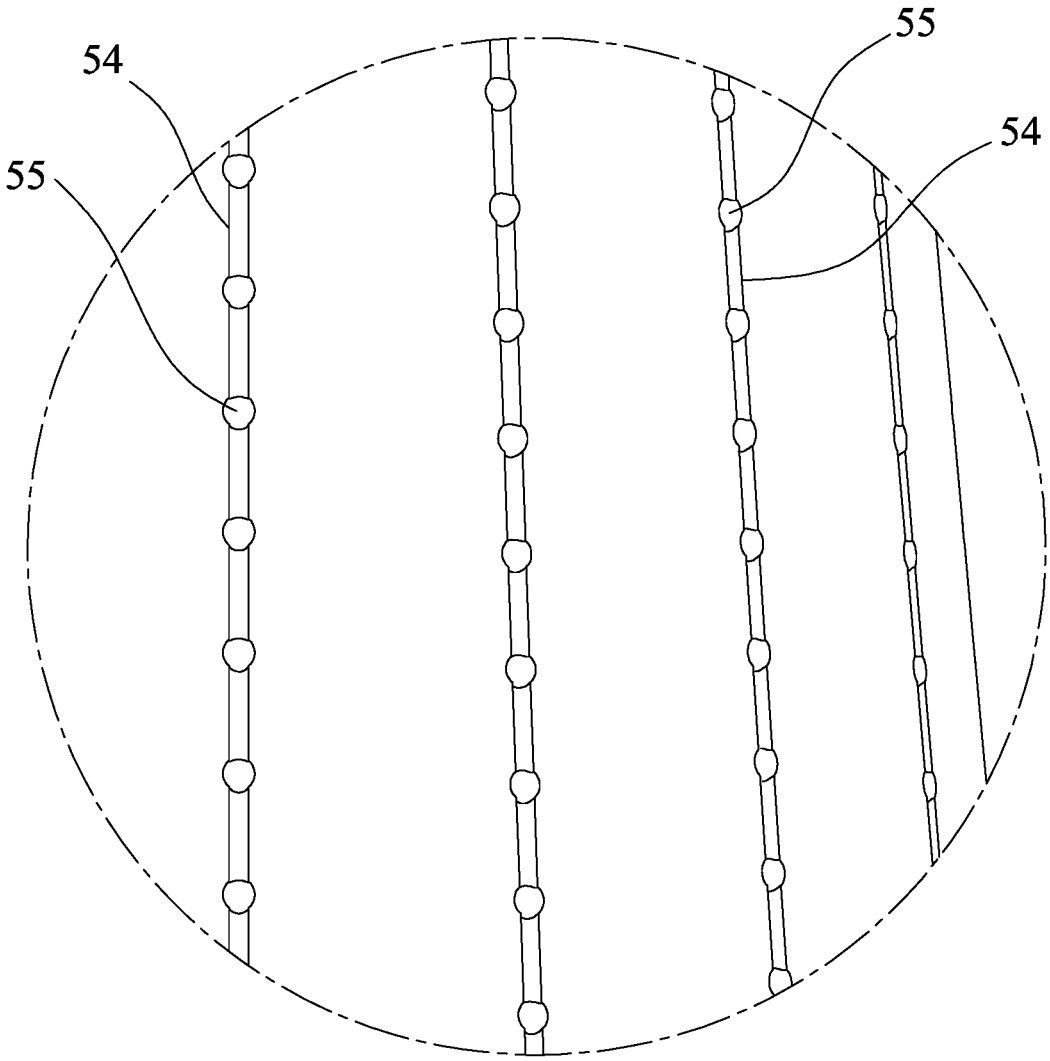
FIG. 5 is an enlarged fragmentary perspective view of the embodiment.
Figure 9:
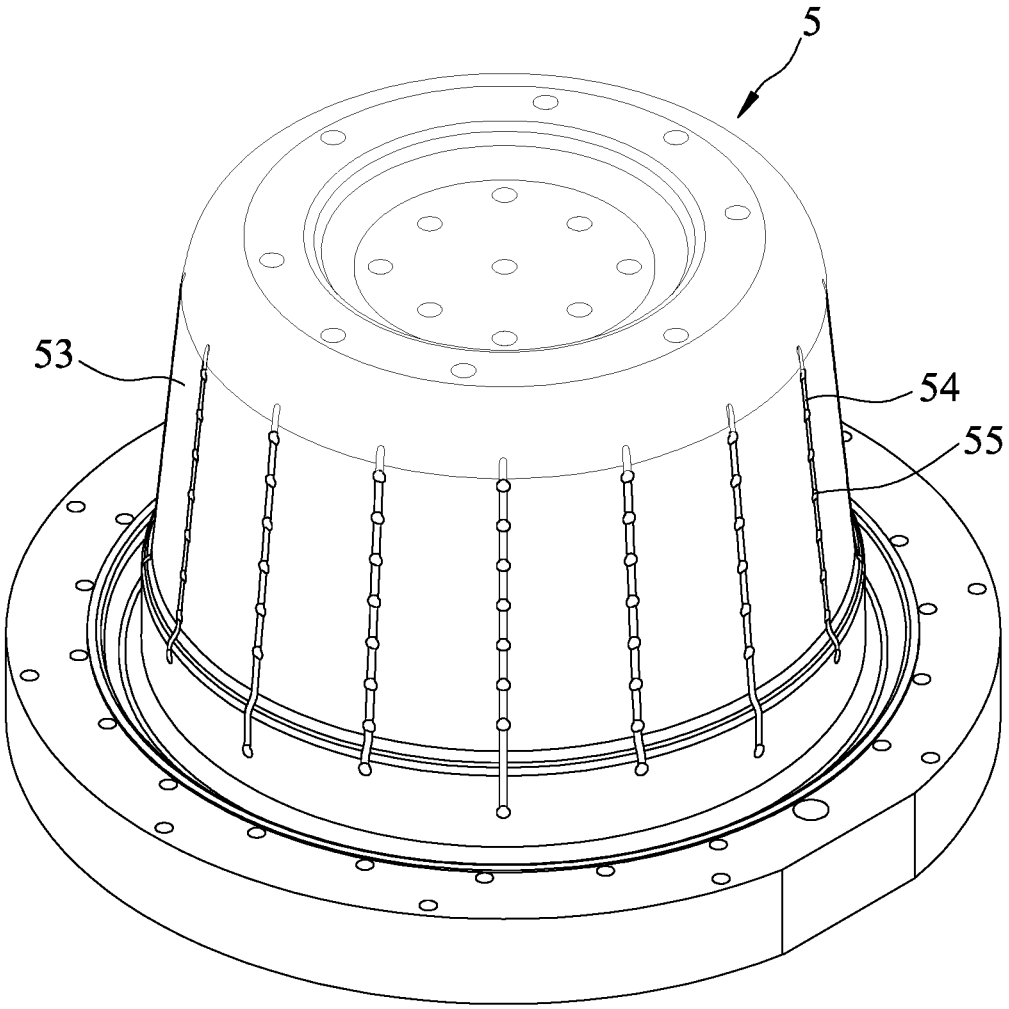
FIG. 9 is an alternative form of the embodiment.

It should be noted that the depth of the pulp mold 5 is not limited to that shown in FIG. 4 for producing the container 4 with a depth greater than 8 cm (see FIG. 8). In other variations of this embodiment, the pulp mold 5 may also be as shown in FIG. 9 for producing a container (not shown) with a shallow depth.

Figure 10:
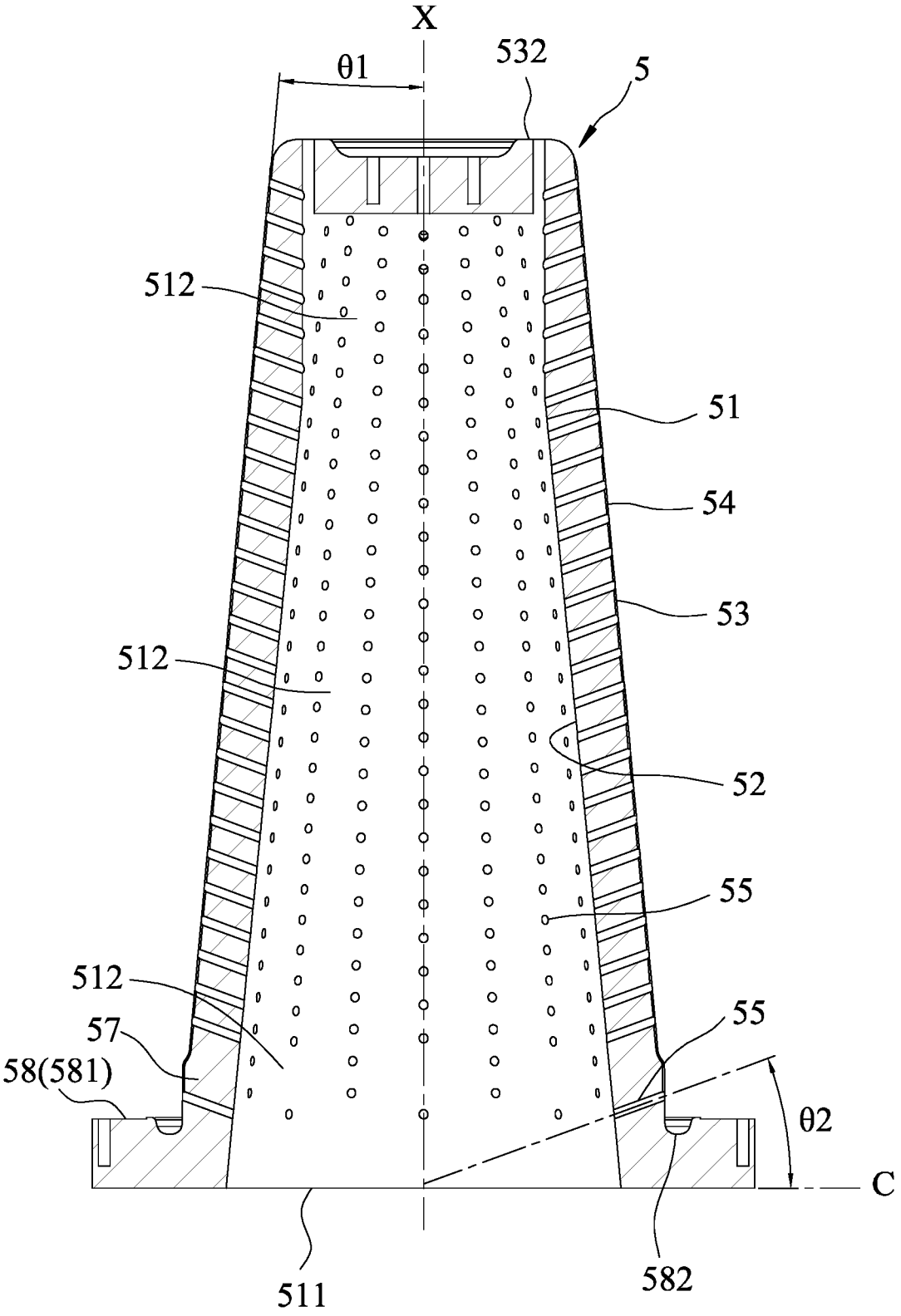
FIG. 10 is a view similar to FIG. 6, but with a chamber having a different shape.

Further, the chamber sections 512 that gradually decrease in diameters are not limited to being correspondingly defined by the inner surface 52 of the mold main body 50 and the step portions 521. In other variations of this embodiment, as shown in FIG. 10, the inner surface 52 is processed to have a substantially U-shaped chamber 51.

From the aforesaid description, the advantages of this disclosure can be summarized as follows:

1. The channel grooves 54 that do not communicate with the chamber 51 can be used to temporarily receive the pulp therein so as to prevent the pulp from passing through the air holes 55 to form barbs, so that the finished product produced by this disclosure can be easily demolded, and the yield of good product can be improved.

2. Through the design of the chamber sections 512 that gradually decrease in diameters upwardly from the opening 511 along the longitudinal axis (X), the quantity of air flow can be effectively increased, sufficient thickness can be retained, and the best balance between easy heat accumulation, heat preservation, improve drainage and mold release effects can be obtained.

3. Since the pulp mold 5 of this disclosure can be made by only using the processing methods, such as turning, milling grooves, and drilling, not only the processing speed is fast that about eight to twelve pulp molds 5 can be produced in one day, but also the production cost of each pulp mold 5 can be reduced to a minimum.

4. Since the channel grooves 54 do not communicate with the chamber 51, and the chamber 51 communicates with the outside through the air holes 53, there will be no disadvantage of releasing the pressure too quickly.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A pulp mold for producing a container formed from pulp, the container including a container main body, and an annular flange formed on one end of the container main body, said pulp mold comprising:

a mold main body extending along a longitudinal axis and having an inner surface defining a chamber that is suitable for air to flow in and out, said chamber having an opening, and being divided into a plurality of chamber sections decreasing in diameters gradually and upwardly from said opening along the longitudinal axis;

an outer surface opposite to said inner surface;

a plurality of channel grooves extending inwardly from said outer surface toward said inner surface and extending along a length of said outer surface, wherein each of said channel grooves does not communicate with said chamber, and a plurality of air holes extending from said outer surface to said inner surface and passing through said channel grooves, said air holes communicating said chamber with the outside.

2. The pulp mold as claimed in claim 1, wherein said air holes are arranged at equal intervals along an extending direction of said channel grooves.

3. The pulp mold as claimed in claim 1, wherein said inner surface includes a plurality of step portions spaced apart from each other along the longitudinal axis, and each of said step portions cooperates with said inner surface to define a corresponding one of said chamber sections.

4. The pulp mold as claimed in claim 1, wherein said chamber is substantially U-shape.

5. The pulp mold as claimed in claim 1, wherein said outer surface includes a conical surface portion surrounding the longitudinal axis, and an end surface portion connected to a narrow end of said conical surface portion that is opposite to said opening of said chamber, said conical surface portion forming a first angle with the longitudinal axis, said first angle ranging from 3 to 15 degrees.

6. The pulp mold as claimed in claim 5, further comprising an annular flange extending outwardly and radially from the bottom of said mold main body, said annular flange of said pulp mold having a top surface, and an annular recess extending inwardly from said top surface for forming the annular flange of the container.

7. The pulp mold as claimed in claim 6, wherein said mold main body further has an annular protrusion extending outwardly and radially from a wide end of said conical surface portion, and is immediately adjacent to said annular recess, said annular protrusion being configured to form an annular protrusion of the container adjacent to the annular flange of the container.

8. The pulp mold as claimed in claim 1, wherein each of said channel grooves 54 has a depth of 0.1 to 5 mm, and a width of 0.1 to 3 mm.

9. The pulp mold as claimed in claim 1, wherein the number of said channel grooves ranges from 3 to 24, and each of said channel grooves communicates with more than five said air holes.

10. The pulp mold as claimed in claim 1, wherein each of said air holes has a diameter of 0.5 to 3 mm.

11. The pulp mold as claimed in claim 1, wherein an extending direction of each of said air holes passing through a corresponding one of said channel grooves forms a second angle with a reference plane perpendicular to the longitudinal axis, and said second angle ranges from 20 to 60 degrees.

* * * * *